US006182425B1

(12) United States Patent
Ficker et al.

(10) Patent No.: US 6,182,425 B1
(45) **Date of Patent: *Feb. 6, 2001**

(54) PROCESS AND APPARATUS FOR FILLING CANS WITH FIBER BAND

(75) Inventors: Frank Ficker, Reichertshofen; Albert Kriegler, Geisenfeld, both of (DE)

(73) Assignee: Rieter Ingolstadt Spinnereimaschinenbau AG, Ingolstadt (DE)

( * ) Notice: This patent issued on a continued prosecution application filed under 37 CFR 1.53(d), and is subject to the twenty year patent term provisions of 35 U.S.C. 154(a)(2).

Under 35 U.S.C. 154(b), the term of this patent shall be extended for 0 days.

(21) Appl. No.: 09/275,253

(22) Filed: Mar. 24, 1999

(30) Foreign Application Priority Data

Mar. 27, 1998 (DE) ..... 198 13 538

(51) Int. Cl.[7] ..... B65H 54/76

(52) U.S. Cl. ..... 53/475; 53/255; 53/430; 53/536

(58) Field of Search ..... 53/475, 473, 536, 53/535, 245, 241, 260, 255, 430, 116

(56) References Cited

U.S. PATENT DOCUMENTS 2,018,261 * 10/1935 Holdsworth .
2,581,042 * 1/1952 Otto ..... 53/536
3,120,249 * 2/1964 Keene ..... 53/536 X
3,426,390 * 2/1969 Whitehurst .
3,930,351 * 1/1976 Ueda et al. ..... 53/475
3,960,280 * 6/1976 Stolzer ..... 53/536 X
5,237,726 * 8/1993 Cartenmann .
5,269,115 * 12/1993 Stentenbach ..... 53/430 X
5,446,946 * 9/1995 Leifeld .
5,491,877 * 2/1996 Leifeld .
5,575,040 * 11/1996 Leifeld .
5,595,049 * 1/1997 Leifeld ..... 53/430
5,743,067 * 4/1998 Trimani ..... 53/236 X
5,787,553 * 8/1998 Liedgens .
5,829,100 * 11/1998 Stentenbach .

FOREIGN PATENT DOCUMENTS

4134642 * 4/1993 (DE) .
2277936 * 11/1994 (GB) .
2287963 * 4/1995 (GB) .

* cited by examiner

*Primary Examiner*—James F. Coan
(74) *Attorney, Agent, or Firm*—Dority & Manning, P.A.

(57) ABSTRACT

Upon filling cans with fiber band, the movable bottom of the cans, as the filling process proceeds, moves downwardly from an initial upper to a lower final position. As this happens, between two elements, one inside, one outside the circumferential shell of the can, a force field is built up in such a way that the element inside the can supports the can bottom and because of the force field, this bottom is held at the same elevation as the element outside of the can. Further, the desired operating height of the can bottom can be correspondingly held. For the lowering of the can bottom, one of the two elements between which the force field exists, is moved relative to the other in the direction of the lower final positioning of the can bottom and the remaining element follows after, because of said force field, until both elements again stand across from one another at the same height. Along with this, for the support of the can bottom a force, directed at right angles to the circumferential shell, is produced to form a braking force directed contrary to the weight of the loaded can bottom.

21 Claims, 4 Drawing Sheets

PROCESS AND APPARATUS FOR FILLING CANS WITH FIBER BAND

BACKGROUND

The present invention concerns a process for the filling of cans with fiber band, and further concerns an apparatus for the execution of said process.

Customarily, a can is provided with an interiorly located, combined system of screw shaped springs and pantographs (DE 42 34 793 C2) to bring about a lowering of the bottom of the can to correspond with the degree to which the can is filled and to prevent the upsetting of the bottom of the can. The fabrication of this kind of scissors linkage or pantograph is, however, expensive in regard to costs as well as to maintenance, especially in view of the fact that pantographs of this type must be provided in every single can.

Further in common knowledge is the provision of longitudinal slots oppositely situated on the can, through which slots, take-along elements connected to the can bottom reach to the outside, where they operate together with provided lifting units which are independent of the cans (DE 44 07 849 A1). For this purpose, special cans are required, which, moreover, as a result of the slots extending over practically the entire length of the can, leads to distortion of the can shell. Besides this, the danger is present, that the fiber band will be damaged by external air borne particulate in the area of the said slots.

SUMMARY OF THE INVENTION

Thus a purpose of the present invention is to create a process and an apparatus, which are economical, require no slots in the cans, and the danger of particulate contamination with band damage is avoided. Additional objects and advantages of the invention will be set forth in the following description, or may be obvious from the description, or may be learned through practice of the invention.

The purposes will be achieved through the features of the invention wherein a process for the filling of cans with fiber band is provided, in which a can bottom, which is enclosed by a circumferential shell of said can and carries the therein deposited fiber band, is so supported that said can bottom, as the filling proceeds, moves downwardly from an initial upper position to a final lower position, therein characterized, in that between elements located in the inside and outside of the circumferential shell, a force field is generated in such a manner, that the element within the can supports the can bottom and is held at the same elevation as the element situated outside of the can, and that the desired elevation of the can bottom is thus maintained. By means of the generation of a force field, oriented essentially at right angles to the lift and lowering direction of the can bottom, the required elements for the support of the can bottom are not required to extend to any substantial degree in the direction of the can movement so that these elements, even upon release of the can above them, take up little or no substantial space.

Through the improvement of the invented process wherein for the lowering of the can bottom, a first of the two elements, between which the force field has been established, moves relative to a second of these elements in a direction toward the final position of the can bottom, and the second of the elements is caused by the force field to follow the first element until the two elements are again in opposition to one another standing at the same level. In this way, the height-positioning of the can bottom, adapts itself, in a simple way, to conform to the quantity of the fiber band laid down on the can bottom.

In an alternative, or extended manner, a force at right angles to the inside of the circumferential shell of the can is generated for the formation of a frictional force which opposes the weight of the can bottom. Even in this case, there is little space provided under the can bottom, since the friction force, which acts against the weight of the can bottom and fiber band, is not brought about by a force oriented in the moving direction of the can bottom, but much more with the help of a force directed at a right angle to said moving direction.

If the process is designed for the lowering of the can bottom, the said friction force must be reduced, at least in a transitory, specified manner, then the motor drives for elements underneath the can bottom can be eliminated.

For the carrying out of the described process, in accord with the invention, an apparatus is made available wherein on both sides of the circumferential shell of the can, elements are provided, between which a force field is generated, whereby the element part, which is inside the can, is a component of a support apparatus for the can bottom and by means of the force field, can be held at the same elevation as that element placed outside of the can, which latter element is a component of an actuator for maintaining level, and which is controllably connected to the level control device. The support apparatuses are held at the desired elevations with the aid of force fields and care for the desired horizontal security of the can bottom, so that pantographs may also be dispensed with. It is even possible, to operate with either customary cans, or in the most simple manner, without great labor or cost expenditure, to operate with cans made to suit the requirements. Further, no greater space need be provided underneath the cans which are in operational position, even when here the running of a control connection should be provided.

Advantageously, the invention may be designed such that the force field producing elements are designed as magnetic elements, since magnetic force fields lend themselves in especially simple ways to both production and control.

In connection with the present invention, the concept "Magnet element" includes not only a simply magnetizable element, but also a ferro-magnetic element, in the form of an iron plate, i.e. sheet iron or the like. In this way, such a magnetizable element can be designed to be installable on the can, that is, the bottom of the can, or else designed as the can bottom itself, or yet a part thereof Principally, the magnet elements can be designed in various ways. If the magnet elements are made such that at least the magnetic element of the level actuator is designed as at least a permanent magnet, particularly made of Neodym, then a particular control of the magnet element can be dispensed with. Again, in relation to the choice of Neodym as a material for the permanent magnet (or magnets) then the use of relatively smaller permanent magnets becomes possible.

In a practical way, the magnet elements of the support apparatus and the level actuator are comprised of a multiplicity of single magnets, which have been bound together in magnet packets.

Since the weight of the fiber band bearing on the can bottom continually increases as the can fills, and thus the magnet elements of the support apparatus have a continually increasing force to support, in an advantageous development of the invention, that even the holding force, which, by means of the magnetic force field between the magnet elements of the support apparatus and the level actuator, is increased as the filling of the can proceeds, by switching in individual permanent magnets or in groups of permanent magnets.

An increase of the active holding power of the permanent magnets is possible to achieve through a development of the apparatus wherein for every magnetic element, a common magnetic short circuit steel plate is installed for the permanent magnets in each magnetic element.

In accord with an advantageous alternative, the magnet element of the level actuator is designed not as a permanent magnet, but as an electro magnet.

In accord with a design of the invention wherein, a support apparatus is provided for the can bottom, which supports itself on the circumferential shell of the can and is bound controllably with the level control device, and, which can be applied in combination with force fields or alternatively thereto, by means of the augmentation of the support apparatus on the circumferential shell of the can, a frictional force can be produced in opposition to the weight of the can bottom laden with fiber band. Also, as to this matter, no rods or other kinds of mechanical contacts between the thrust unit and the can bottom is necessary, since it suffices, if the thrust unit is bound to corresponding support apparatuses with assist from appropriate control connections.

Advantageously, more than one single supporting apparatus for the can bottom is provided, since these can thereby be designed smaller and in an especially secure manner, can assure a horizontal orientation of the bottom of the can.

In accord with a further alternative embodiment, an electrical line for energy supply is connected to the support apparatuses for a drive, or the like, so that, the support elements can be brought out of their bottom idling position into an upper operational position. If a direct control type connection is provided between the support apparatus and the level control device, this being simply a line, that is, a transmission cable, through which control directives can be sent to the support apparatus, then the support apparatus can assume the desired vertical position within the can and, in addition, is able to hold the can bottom at the said desired height.

Advantageously, the support apparatuses are not continuously affixed to the can, but, the support apparatuses are brought against the shell of the can, so that neither the external sell of the can nor the movable can bottom requires any special construction.

Consideration can be given to undertaking propping the can bottom with the aid of the support apparatuses in combination with one or more pressure springs. A determination of the support force is advantageous for an expedient selection of springs of this sort underneath the can bottom.

According to the type of design, that is, according to the control of the support apparatuses, an improvement of the invented apparatus wherein the level control device is designed in such a manner that, depending on the lowering movement of the support apparatus, its holding power is increased, can be of advantage in order to be able to match the active supporting force of the said support apparatuses to the active band weight as the latter increases as the can fills.

In accord with a preferred design of the invented apparatus, a level actuator is provided to at least one of the support apparatuses, which level actuator is located on the outside of the circumferential shell opposite to one of the support apparatuses and by means of the level control device is movable along a generatrix of the can and in the area of the lower end section of the can signals a release movement for the freeing of a full can, i.e. signals the replacement for an empty can to be held in readiness. A control apparatus is dedicated to at least one of the support apparatuses, since this is the preparation for an especially simple control of the motion of the support apparatus.

Independent of the means by which data transmission is carried out to the support apparatus, by means of a design wherein the level actuator and/or the control element possesses a sensor or an impulse sender, which, upon the appearance of, or a deviation of, position between level actuator and the support apparatus, a compensating motion of the support apparatus or of level actuator is released for the equalization of the position deviation. An improvement can be achieved, in that either by the movement of the level actuator initiated by the level control device, the support apparatus releases the execution of a corresponding follow-up motion, or in that upon a lowering of the support apparatuses which results from the increasing weight on support apparatuses, the control system is brought to carry out the corresponding, necessary compensating movement through appropriate control by the lift drive.

In case of an unexpected interruption of the current supply to one of the electromagnets, or by interruption of another kind of energy supply, so that the support apparatus does not fall into its end position because of its weight, it becomes very important that the support apparatus is designed with a safety catch mechanism which, upon loss of the energy supply, becomes active and upon restoration of energy becomes deactivated.

The support apparatuses and the related control components should not remain stationary at a definite point on the can. Contrary to this, by means of the lift drive, they must be gradually moved out of a start position near to a filling head, which lays the fiber band onto the can bottom. While this is being done, the spatial interval is maintained between the receiving surface formed by the laid down fiber band and the filling head until the can bottom within the can has reached its lower end position. During this entire time, the requirement is that the support apparatuses permit the bottom of the can, in accordance with the degree of being filled, to gradually recede from the filling head.

To accomplish this, the support components must be moved gradually parallel to the axis of the can along a generatrix of the cylindrical can shell.

In order to hold the resistance to be overcome between the support apparatuses, that is to say, the control apparatuses, and the can shell as low as possible, the apparatus in accord with the invention is preferably designed such that an augmentation support member controllingly communicates to the support apparatus and the level actuator, in particular in the form of rolls for support against the circumferential shell of the can.

To stiffen the lower rim of the can, as well as to fix the lower end position of the can bottom, the lower rim of the can, as a rule exhibits a bulge. In order to be able, in spite of this, to free the can for the can-exchange operation, in accord with the invention, a movability of the control apparatus and/or the support apparatus is provided. The support apparatus as well as the level actuator, insofar as they are proximal to said the side exhibiting the said bulge, are movable essentially at right angles to the circumferential shell of the can.

The process and the apparatus in accord with the present invention enable, in a simple way, a lowering of the can bottom in proportion to the rate of filling the can. This can be done without the disadvantage of using complicated can shapes or can construction. If no changes are desired to be made on the cans at all, even then the present invention can find application. This is because it completely suffices, when the machine which handles the can is equipped with the invented apparatus, which apparatus then places the support below the can bottom and carries out the controlled lowering of said can bottom.

Embodiment examples and further details are given in the following description with more complete explanations with the help of the drawings. There is shown in:

DETAILED DESCRIPTION

Figure 1:
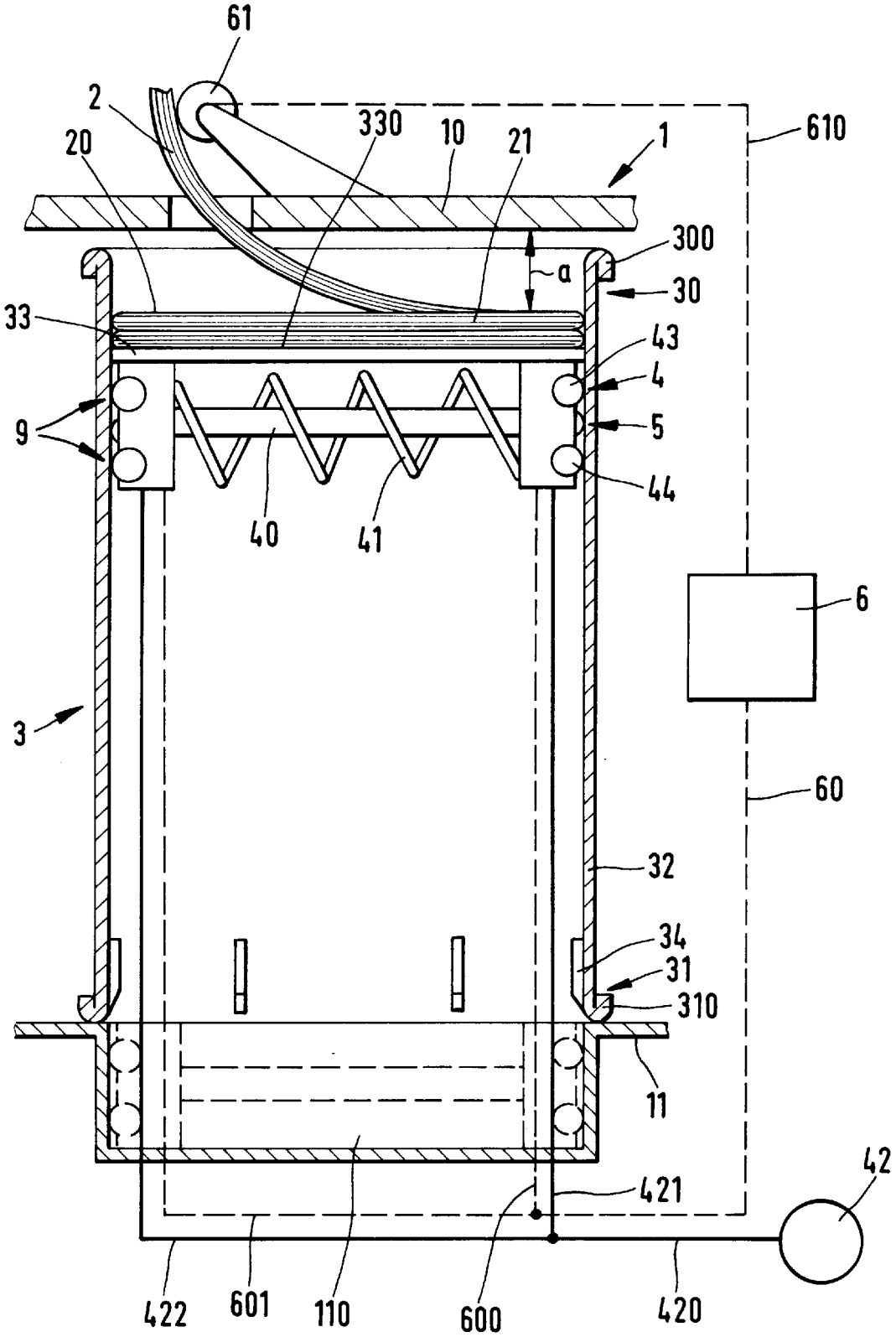
FIG. 1 in schematic presentation, a can situated beneath a filling head with the support apparatus for the can bottom, FIG. 2 in side view, a modified design of the of the support apparatus shown in FIG. 1, FIG. 3 in a schematic presentation, a further modification of the apparatus in accord with the invention and FIG. 4 in a perspective, exploded presentation of a modification with permanent magnets placed in the invented support apparatus as well as for a control apparatus for one of the support apparatuses.

Reference is now made to preferred embodiments of the invention, one or more examples of which are illustrated in the drawings. Each example is provided as an explanation of the invention and not meant to limit the invention. It should be understood that various modifications and variations can be made in the invention without departing from the scope and spirit of the invention.

The invention is first explained with the help of FIG. 1, which simply shows the required elements necessary for the understanding of the invention.

At a filling station 1 of a textile machine delivering fiber band 2, for instance, this being a stretch works (draw frame), a turntable 10, driven in the usual way, is disposed above its receiving can 3, for the purpose of uniformly distributing the fiber band 2 during its deposition in said can 3. In the course of the fiber band 2, is located a length measuring device 61 for the measurement of the length of the band 2 brought to the can 3.

The can 3 is of conventional construction and possesses, in accord with the subsequent working stage, a round (or oblong) cross section. Independently of said cross sections, the can exhibits respectively on its upper end 30 as well as on its lower end 31 of its circumference, a bulge 300, 310 toward the outside. This bulge contributes to the stiffening of the rim of can 3. Enclosed within the circumferential shell 32, the can 3 possesses a can bottom 33, which is height-adjustable inside of the can. This height-adjustment is to allow the spatial interval between the turntable 10 and the deposition surface 20 for the fiber band 2 to be always held constant. For this purpose, uniform band depositing is achieved, which is of eminent importance for a disturbance-free future working of the stored fiber band 2. When the can 3 is empty, this depositing surface 20 is formed by the upper side 330 of the of the can bottom 33. After a filling procedure has been initiated, the surface of the layer 21, proximal to the turntable 10, which layer 21 is placed on the already laid down fiber band 2, becomes the depositing surface 20.

At that initiating moment, the can bottom 33 is brought into position at the desired height and is held there, resting on support apparatus 4. Two or more of these support apparatuses are uniformly and equally apportioned about the circumferential shell 32. The support apparatuses are further provided at equal height within the can 3.

In the case of the embodiment presented in FIG. 1, diametrically opposite one another are two support apparatuses 4 bound together underneath by means of a carrier 40 which is loaded by means of a common compression spring 41, or the like.

This said spring, reacts against the two support apparatuses 4 which are diametrically opposite one another, so that both support apparatuses 4 are elastically pressed against the inside of the circumferential shell 32.

The two, or all, if more than two, common support apparatuses 4 for a can bottom 33 are respectively constructed in identical manner and, by means of an electrical line 420, 422, stand in contact with a common energy supply line 420, which, in turn, is connected to a corresponding energy source 42.

Figure 2:
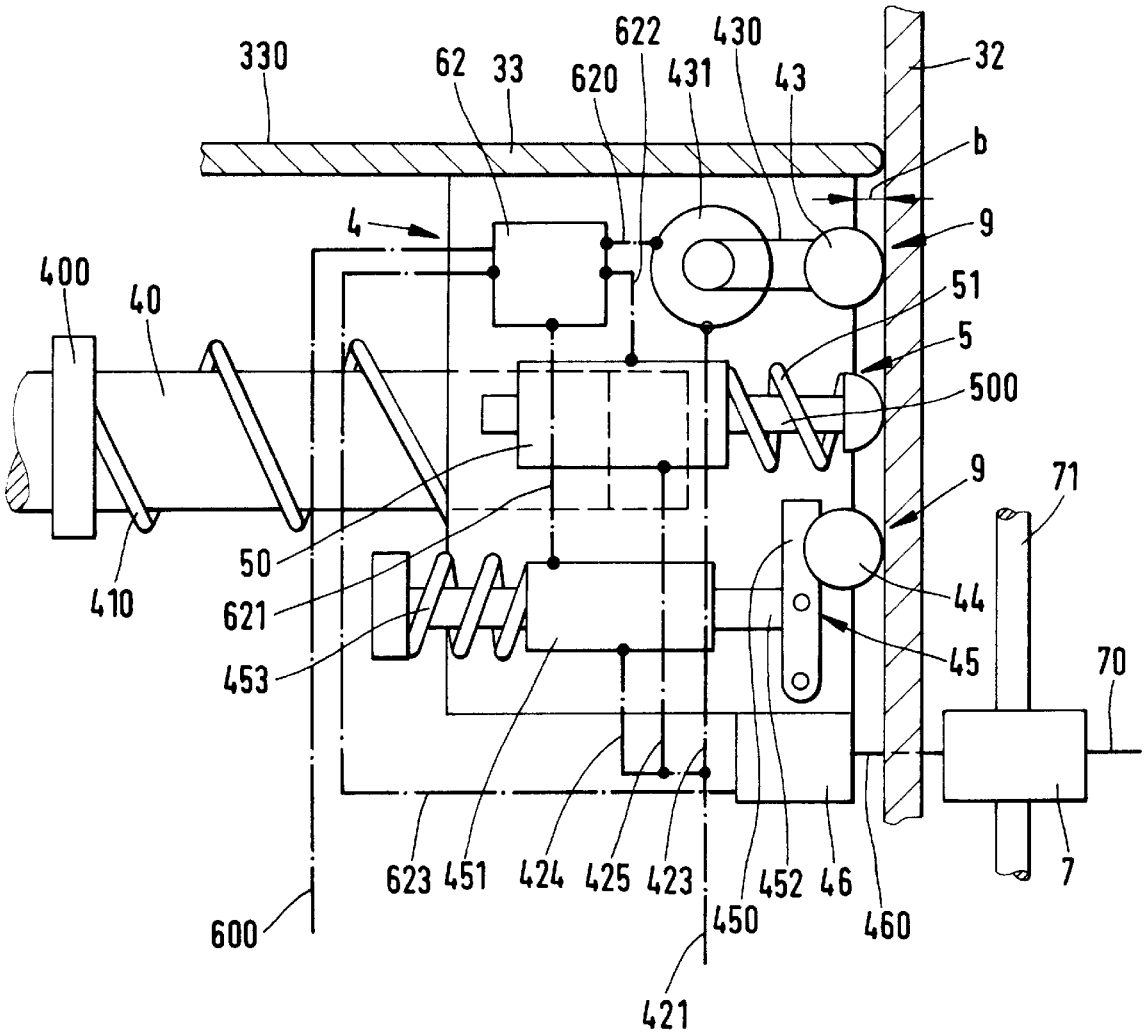

As indicated in FIG. 1 and shown in detail in FIG. 2, the support apparatuses 4 support themselves, not directly on the inside of the circumferential shell 32, but with the help of an auxiliary brace 9, which, in accord with the embodiment shown in FIGS. 1 and 2 possesses rollers 43 and 44, in order to reduce the friction between the support apparatus 4 and the circumferential shell 32. The roller 43 (or a corresponding roller pair) is, by means of a drive transmission 430, or the like, connected to a lift drive 431. This drive motor, by means of a line 421, 422 joins line 420 to the energy source 42. (See FIG. 1)

The other roller 44 (or a corresponding roller pair) is installed for a brake 45. This possesses a brake shoe 450, which, upon being loaded by means of an electromagnet 451 is brought into contact with the roller 44. The armature 452 which is connected to the brake shoe 450 of the electromagnet 451 is loaded in the opposite direction to the above mentioned drive by a compression spring 453, which, upon interruption of the current feed, lifts the brake shoe 450 from the roller 44. The current supply is made with the help of a line 424 connected to the line 421. (See FIG. 1).

Each support apparatus 4 exhibits further a safety catch 5, which, as shown in FIG. 2, possesses a clamping element made by the armature 500 of an additional electromagnet 50, which, upon the drop-out of electromagnet 50 through a compression spring 51, which supports itself as well on the electromagnet 50 as on the armature 500, and which spring 51 is pressed against the circumferential inner wall 32 of the can 3.

The electromagnet 50 is in contact through a line 425, then to line 421 and, likewise with line 420 which runs to the source of energy 42.

For the control of the lift drive 431 as well as the electromagnets 451 and 50, each support apparatus 4 possesses a sub-control unit 62, with which the said elements, with help from control lines 620, 621 and 622, is connected. The control unit sub- stands, with the help of lines 600, (that is, 601, etc.) and data transmission line 60 (for instance, a corresponding data transmission cable), the cable being in common for several support apparatuses 4, with a level control device 6 in a controlling connection (see FIG. 1), with which, by means of a line 610 also the already mentioned length measuring apparatus 61 is connected.

Underneath the can 3, the filling station 1 shows a can base flange 11, which, in the case of a round can 3, is designed as a foot plate and is provided with a drive. However, if the can 3 does not have a round cross-section, but is constructed with an oblong cross-section, then the can base 11 is designed to be stationary, that is, not rotatable. The can base 11 possesses, in accord with FIG. 1, a basin like recess 110, which is designed to receive the support apparatus 4 when this occupies its lower end position (see dotted lines in FIG. 1).

The can 3 has, in proximity to its under end 31, on the inside of its circumferential shell 32, coaxially oriented reinforcement ribs 34, which support the can bottom 33 when the can 3 is filled, and thus the limits the lowering movement of the can bottom 33. The vertical lifting path of the support apparatus 4 is so selected that it runs between two such support ribs 34.

After the embodiment in accord with FIGS. 1, 2 is described in its construction, now its function should be made plain.

In the start situation in which the filling station 1 is empty, the support apparatuses 4 take their place in the recess 110 of the base 11. In this way, they are not obstructing the can 3 as the can is brought into its operational position underneath the turntable 10.

When the can 3 is in position, then a control directive is sent to the sub-control unit (FIG. 2) in the appropriate way by means of the level control device 6 (FIG. 1) through the data transmission line 60 as well as the lines 600, 601.

This directive, over the line 620 (FIG. 2) switches in the lift drive 431 so that this thrust unit drives the support apparatus 4 into its upper end, or operational position. So that the lift drive 431 can move the support apparatus out of its idle position, simultaneously, the electromagnet 50 (FIG. 2) is energized over the line 622, whereupon armature 500 pulls against the action of the compression spring 51, bringing about the result that a release of the clamp action of the safety catch 5 occurs.

Since, the now rising support apparatuses 4 are leaving their lower end position, and now first come into the under end zone of the can 3, at which point they impact, from below, against the can bottom 33. During its further lifting motion, the support apparatuses 4 lift the can bottom 33 away from the retaining ribs 34 and bring it into its upper end position, in which the upper side 330 of the can bottom 33 assumes the desired spatial interval "a" from the turntable 10. In this position of the can bottom 33, the lift drive 431 of the support apparatus 4 is held motionless and at the same time, the electromagnets 451 of the brake 45 are activated, which now press their brake-shoes 450 against their associated rollers 44 (or the corresponding roller pair), so that the can bottom 33 is secured in its present position. This securing of the support apparatuses 4 in their (present) operational position is carried out in this way to generate a braking force directed against the inside of the circumferential shell 32 of the can 3, which is carried out by the compression spring 41 which coasts with the brake 45. The braking force, or holding force, is essentially oriented at right angles to the circumferential shell 32. Said force requires for its generation and holding ability, principally components which extend themselves essentially parallel to the can bottom 33. This braking force brought on from the support apparatuses 4 secures them in their presently raised position by the generation of a frictional force, which is directed against the weight of the can bottom 33 along with the weight of the fiber band 2 which accumulates thereon.

A further advantageous aspect now arises, in that the can bottom 33 ties on the support apparatuses 4 within the can 33 and this is made use of to support the can bottom 33 in a desired and thus specified raised position.

Even if not expressed in so many words, it should be understood that all support apparatuses 4, which, in common, support can bottom 33, also receive control directives simultaneously, so that the support apparatuses 4 carry out the same operations in synchronization. Consequently, they are found always at the same height relative to the can 3.

Now the filling procedure is introduced. In a conventional manner the turntable 10 is driven so that the fiber band 2, in the usual way, is distributed in the can 3 during the filling. At the same time, the can 3 is subjected to an appropriate movement. In the case of a round can 3, this is a rotational movement which is imparted to the can 3 with the help of the foot plate (flange) 11 which is set into rotary motion. In the case of a round can 3, foot plate 11 also serves for support for the can 3. If the situation is that the can 3 is oblong in cross-section, that is, in regard to a so-called rectangular can, then this, in a conventional, and hence a not diagrammed manner, is given a reciprocating motion in the direction of the greater dimension, to which a back-and-forth motion at right angles thereto is overlaid.

While the fiber band 2 is being fed to the can 3, it contactingly passes the length measuring equipment 61, which thereby measures the length of the fiber band 2 fed to the can 3. The determined measurement data are continuously conducted over the line 610 to the level control device 6. This level control 6 releases periodically, dependent upon the filling process, that is, from the registered input of fiber band 2, by means of appropriate control directives to the support apparatus 4, that:

- the brake 45 for the reduction of the brake force for an incremental period should be temporarily locked,
- thus the friction force is to be temporarily reduced correspondingly,
- that the support apparatuses 4, as well as the can bottom thereon carried, are to be gradually and continually lowered in accord with the progress of the can filling.

If the can becomes full, than the can bottom 33 reaches it lower end position, in which said bottom then impacts the support ribs 34 and comes to stillstand.

The support apparatuses 4, on the other hand, continue their downward motion until they reach their own end position within the recess 110 of the can base 11. When this end point is reached, the energy supply is broken off and the support apparatuses also are at stillstand. In this case, the brakes 45, by means of action of the compression spring 453 are released, while at the same time the compression spring 51 brings the safety catch 5 into its clamping position.

This safety catch 5 is not needed during normal operation, since the lowering motion of the can bottom 33 is controlled by the aid of the brake 45, and hence, said safety catch 5 can, in some circumstances, be dispensed with. Otherwise, it is of great advantage in the case of an interruption in the current supply to the support apparatus 4 during the filling procedure. Should, for any reason, an interruption of the current supply to the support apparatus 4 occur while the can bottom 33 was not resting on the support ribs 34, then the current position of the support apparatus 4, and along with it the can bottom 33 with the thereon loaded fiber material, could not be satisfactorily maintained by a resistance to downward motion engendered by the lift drive 431. Since the brake 45 releases upon loss of current, the support apparatuses 4 would more likely fall with impact into the recess 110 of the can support base 11. This, however, would be prevented by the safety catch 5 which is activated upon current loss and presses the armature 500 of the electro magnet 50 against the inside of the circumferential shell of the can 3. This naturally presupposes that the support apparatus 4 cannot avoid this pressure brought against the circumferential shell 32 of the can 3, which, by means of an apt choice of the compression spring 41, giving consideration to the spring constant would be ensured. The safety catch 5 for the support apparatus 4 and in turn the can bottom 33 is activated by loss of current and upon restoration of current becomes inactive.

The safety catch 5 can be built in various ways, for instance being similar to the depicted brake 45 and, by means of a lever comparable to the brake-shoe 450, coact with the roller 43 and/or 44.

In accord with the design of the safety catch 5 it can also be advantageous if, at the time of its release upon restoration of energy supply, the support apparatus 4 carries out a short thrust motion in the direction of the filling head, for instance, in order to release one of the safety catch 5 arrests (not shown).

As FIG. 2 shows, instead of a common compression spring 41 for two support apparatuses 4 positioned diametrically opposite from one another, it is possible that for each support apparatus 4, respectively one individual compression spring 410 is provided, which springs anchor themselves on a corresponding spring plate 400 (or the like) affixed to carrier 40.

The above description presupposes, that the friction force working against the lowering of the can bottom 33, which was engendered by the brake 45, is so large that it, of itself, could secure the can bottom 33 under conditions of maximum load at any desired position. Further the assumption was made that locking would take place from time to time for short periods in accord with suitability of position in regard to the thickness of the deposited layers 21 in the can 3. As an alternative, the holding force brought about by the brake 45 can be made to match the momentary thickness (or weight) of deposited layers 21. In accomplishing this alternative, the restraining force need only be measured to the degree, that the increasing weight of the deposited fiber band 2 in the can 3 acts as a position-corrective for the can bottom 33, so that this motion is then limited by a gradually increasing, restraining force exerted by the brake 45.

For the control of the brake 45, in accord with a depicted variation in FIG. 2 of the previously described apparatus, outside of the can 3 a level actuator 7 is provided, which, by means of a line 70, is connected to the level control device 6. The level actuator 7 is situated on a spindle or another appropriate vertical movement apparatus, with the help of which the said level actuator 7 can be displaced vertically parallel to the circumferential shell 32 of the can 3. The spindle 71 is connected to a drive 710, which, by means of a line 63, is controllably connected to the level control device 6.

The support apparatuses 4, or one of these, exhibits a control element 46 which acts in conjunction with the level actuator 7, which latter is located outside of the can 3 (see the dotted line 460, which indicates this coaction). For this purpose, the level actuator 7 is connected with the level control device 6 by a control line 623 and the sub-control 62. For instance, operation is carried on not only by the level actuator 7, but as well by the control element 46 by a combination ultrasonic-sender (=impulse emitter) and receiver (=sensor). Or, the actuator 7 is principally designed as an ultrasonic sender (impulse emitter), while its associated control element 46 is designed only as an ultrasonic receiver (sensor). Also other non-physical contact impulse emitters or the like and corresponding receivers can find application instead of the named ultrasonic equipment.

The level actuator 7 and the control element 46 coact in such a way that, upon relative height differences (=position deviations), a balancing action occurs between them, since they engender a corresponding compensating motion of the follow-up support apparatus 4, which is to say, the follow-up level actuator 7, according to which of the two apparatuses initiates action. This can come about in different ways.

For instance, the brake force of the brake 45 can be only so strongly put in force, that the so generated friction force is enabled to hold the can bottom 33 with the fiber band weight deposited thereon. Then, upon further increasing weight, the can bottom 33 is pressed downward and thereby moved in relation to level actuator 7, which is immediately registered by the coaction of level actuator 7 and the control element 46. The control element 46 immediately emits a corresponding directive to the support apparatus 4, whereupon the brake 45 increases its braking force and thus, also the friction.

Since the level control device 6 and the length measuring device 61 are connected, the level actuator 7, dependent upon the measured band length, can also be positioned along the height of the can 3 by means of the spindle 71.

Thus the brake force can be controlled in such a manner that the holding force of the support apparatus 4, that is to say the brake 45 thereof, is controlled in accord with the length of the deposited fiber band 2 in the can 3. In this way, also a feedback loop of the motions of the level actuator 7 and the support apparatus 4 can be established. This is possible because, the level actuator 7, which is displaced in accord with the measured length of the fiber band 2 deposited in the can 3, monitors the position of its associated control element 46. If the control apparatus 7 preempts the control element 46 as a result of the drive provided to it by the spindle 71, then it emits a corresponding signal to the level control device 6, which now, by means of a resulting signal directive to the support apparatus 4, calls for a retract of the same through a temporary reduction of the braking force of the brake 45.

The braking or holding force is thus controlled in direct or indirect dependency on the lowering motion of the support apparatus 4, and continually exhibits such a magnitude that said force, in spite of increasing weight of the deposited fiber band 2 in the can 3, reacts to insure a controlled motion of the can bottom 33.

If the positioning of the can bottom 33 is controlled on the basis of the weight of the fiber band 2 deposited in the can 3, then the band length measurement device 61 may be dispensed with.

The described support apparatuses 4 can not only serve as support of the can bottom 33 and the carrier of the weight of the deposited fiber band 2, but also to compensate for the overturn tendency of the said can bottom 33. To this end, the sustaining force of the support apparatus 4 can be so directed that the can bottom 33 is held in its momentary position by the support apparatus 4 alone, independent of the degree of filling of said can 33.

Otherwise, there is also a design in which the increasing weight of the deposited fiber band 4 in a conventional manner is transferred to compression springs (not shown) provided underneath the can bottom 33.

This arrangement has the advantage that the supporting apparatus 4 alone can take over the task of preventing the can bottom 33 from tipping.

The above design considerations have continually leaned toward at least two support apparatuses 4 which can be put into action within the can 3. However, it can still be fully sufficient, under certain circumstances with appropriate construction and arrangement, to provide only one individual support apparatus 4. This can be especially of advantage—but not in all cases—if the support apparatus is supplied in combination with compression springs, since in that case the forces required to be expended on the part of the support apparatus 4 for orientation stability need not be too large.

The can 3, instead of an outward bulge in its lower section, 310, can also show an inward bulge (not shown) for the support of the can bottom 33 when found in its lower position. In order that such an inward bulge is not an obstruction, the support apparatus 4, which moves along a generatrix of the can 3, may be equipped with either a correspondingly designed auxiliary brace 9 (for instance, large rollers 43, 44, etc.) or must execute an inwardly (in respect to the circumference 32 of the can 3) directed movement. The support ribs 34, in such a situation, may be omitted.

Predicated above, without being so stated, is that electrical current is the energy which is supplied to the support apparatus 4 from the energy source 42. The energy can, however, be another medium, for instance, a gaseous or liquid medium may find application. In such a case it is obvious, that the individual components of the support apparatus 4, especially those on the control aggregate belonging thereto, are required to be adapted to the requirements of the chosen medium installed.

As already emphasized in the above description, a modification of the therein described apparatus, within the framework of the present invention, is possible in many aspects. For instance, by the exchange of features with equivalents or in other combinations thereof.

In this manner, there is presented as an augmentation of the embodiment shown in FIG. 1, an example wherein the support apparatus 4 communicates with the level control device 6 by means of a data transmitting line 60 and additional connections to said line 60, namely 600 and 610. As FIG. 2 shows however, a connecting line system of that kind between the support apparatus 4 and the level control device 6 can be omitted if the data exchange is done through non-physical contact, i.e. with the aid of ultrasonics.

It is not a requirement, that the support apparatus 4, in consideration of the braking force or holding force which is to be exercised upon it, is self sufficient. Contrary to this, the support apparatus 4 can carry out the desired support functions in coaction with a counter-element outside of the circumferential shell of the can 3. For this purpose, various possibilities present themselves, as will be explained below in greater detail. For instance, the holding or braking force can be generated, in that attraction or force fields can be brought to activation through the circumferential shell of the can 3. This is done, for instance, in the form of electrical fields, which build up between associated or coacting plate condensers, the potentials of which are appropriately controlled in order that the strength of the fields can match the requirements for the particular moment.

However, not only the data transmission to the support apparatus can be done without physical contact. It is also possible to provide a support apparatus 4 inside the can 3, which support apparatus is supplied with energy without the aid of a connecting line. A modification of this will be explained below with reference to FIG. 3. The apparatus schematically shown in simple form in FIG. 3, exhibits a counter element, i.e. a modified level actuator 7, outside the can 3, with which the support apparatus 4 cooperates in a non-physical contact manner. This level actuator 7 is designed as an energy transmission element and on this account possesses, in accord with FIG. 3, an electromagnet 72 which is carried by an pivoting arm 720 on a spindle 71 and further stands in electrical contact with thrust control apparatus 6.

The mentioned non-physical contact control connection is carried out by a magnetic force field which is generated between the elements, of which elements one is on one side, and the other is on the other side of the circumferential shell 32 of the can 3. The element on the inside of the can 3 is, in this case, is comprised of a magnetic element 47 of the support apparatus 4, and the element exterior of can 3 is formed by the electro magnet 72 of the level actuator 7. The outer of these elements, i.e. magnetic element 72, with the aid of the force field, holds the inner magnetic element 47 at the same height, which corresponds to the desired height.

The concept "magnetic element" used above should embrace not only magnets, but also magnetic materials, for instance, ferro magnetic materials. Thus, the illustrated magnetic element 47 is designed in the form of a ferro magnetic element. Since a ferro magnetic element can be built in a very simple manner, this permits installing it without great expense on the can bottom 33, that is, to construct the said element as an integrated part of the said can bottom 33. This makes it unnecessary, that the magnetic element 47, here designed as supporting apparatus 4, or a component thereof, must always be run down into the recess 110 of the can base 11 and then later brought back up again for can exchange. With such a procedure, the circumferential shell 32 of the can 3 must be repositioned anew, since it is permanently connected with said magnetic element 47.

The mentioned electromagnet 72 serves as a second element for the generation of the said magnetic force field. The required holding force for the support of the can bottom 33 at the momentary height, is achieved through corresponding energy loading of the electromagnet 72. The height which the can bottom 33 is to attain is reached in that the electromagnet 72, with the aid of the spindle 71, is run up to that said height. Because of the magnetic force, which communicates itself without contact penetratively through the circumferential shell 32 of the can 3 to the magnet element 47 which is located within the can 3 and in the form of a magnetic force field, makes the control connection between the electro magnet 72 and the magnet element 47 of the support apparatus 4.

Thus this magnetic element 47 follows after the electromagnet 72 if this should leave the height position of the magnet element 47.

In this way, the forces of attraction utilized for the lowering of the can bottom 33, which forces, in accord with the described embodiment, were generated by magnetic fields, were step by step impelled in the direction of the lower end position of the can bottom 33. At the same time, independently of the last described embodiment, at all times, one of the elements between which the force field is generated is moved in the direction of the lower end position of the can bottom 33. Simultaneously, the other of these elements carries out a compensating movement, until the two elements (magnet element 47 and electromagnet 72) once again stand opposite one another at the same elevation.

As has already been mentioned, the electromagnet 72 is not directly installed on the spindle 71, but with the help of the pivotable arm 720 is connected with the help of a (not shown) coupling member with a pivot drive 721, which, on its own part, stands in electrical connection with the level control device 6 through a line 65. If now a full can 3 at the filling station 1 is to be removed, and an empty can is to be brought in, then the pivoting drive is activated, which swings the electromagnets 72 out of the path of the can 3 in a motion component oriented at right angles to the circumferential shell 32 of the can 3. This is especially important, if, by an axial motion of the level actuator 7 a bulge, i.e. bulge 310, must be passed by, since in this way, complicated designs can be avoided for the level actuator 7, especially in consideration of the support against the circumferential shell 32 of the can 3.

It is obvious, that an arrangement of this nature can also be employed with an apparatus such as that in FIG. 2. This could take place if the level actuator 7 should take up such a position, that it could interfere with the described movement of the can in any way. In any case, for this purpose, a flexible arrangement or suspension for the level actuator 7 suffices.

The previous description covered an active movement of the level actuator 7 with the idea of a releasing movement for the freedom of movement for the can.

Now, instead of this, the concept is one of placement motion to a readied can 3. Thus a passive motion, activated by a contact of the level actuator 7 with the circumferential shell of the can 3, can be completely sufficient.

Figure 3:
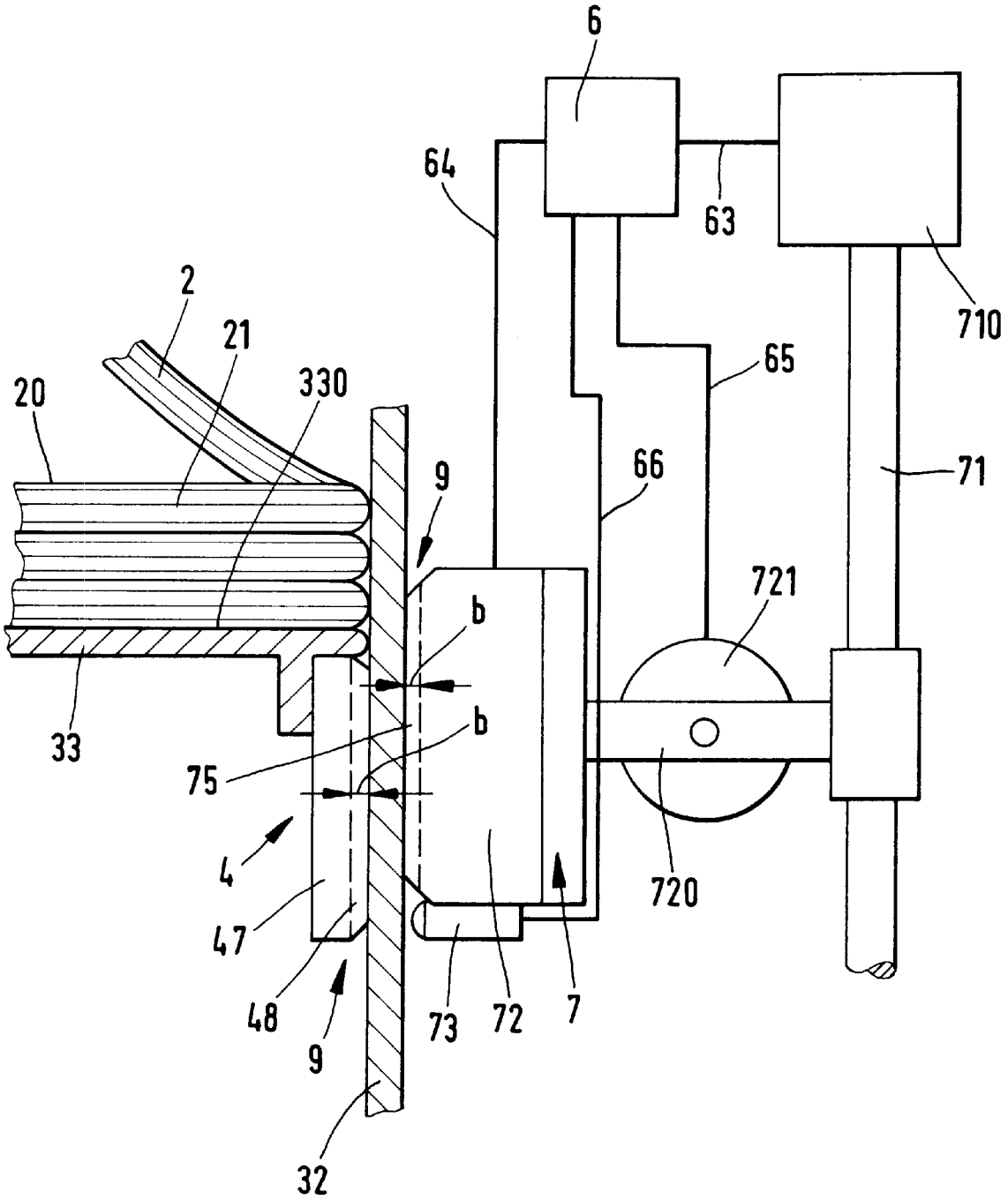

As FIG. 3 shows, the level actuator 7 can possess, additionally to the electro magnet 72, an element 73, which is similar to the level actuator 7 described in connection with FIG. 2. The similarity exists in determining the position deviations relative to the magnet element 47, which can come into play because of the increase in weight of the fiber band 2 deposited on the can bottom 33. The deviations are determined by means of a drive of the electromagnet 72 activated by the level control device 6. In this case, the element 73, which is in connection with the level control device 6 through an electrical line 66, initiates a corresponding compensation motion of the electromagnet 72, which is to say, also the follow-up support apparatus 4.

In the case of a level actuator 7 which possesses an electromagnet 72, in order to avoid that the support apparatus 4 upon failure of current (or an interruption of any sort) can fall down into the recess 110 in the can base 11, the support apparatus 4—independent of its other designs—can possess a safety catch 5, which can be very similar to the holding assurance depicted in FIGS. 1 and 2 which, however, is controlled not on a direct connection through the magnet 50, but is controlled by by magnetic force. Upon an activated electromagnet 72, this will lift a clamp element of the safety catch 5 by a magnetic impulse away from the circumferential shell 32 of the can 3. As a result, the electromagnet 72 starts downwardly moving. Because of the now missing magnetic field, the compression spring 51 brings the clamping element into its clamping position (instead of the armature 500 shown in FIG. 2). Similar to the safety catch described with the help of FIG. 2, this safety catch also is active only during an interruption of the energy supply to the electromagnets 72.

Figure 4:
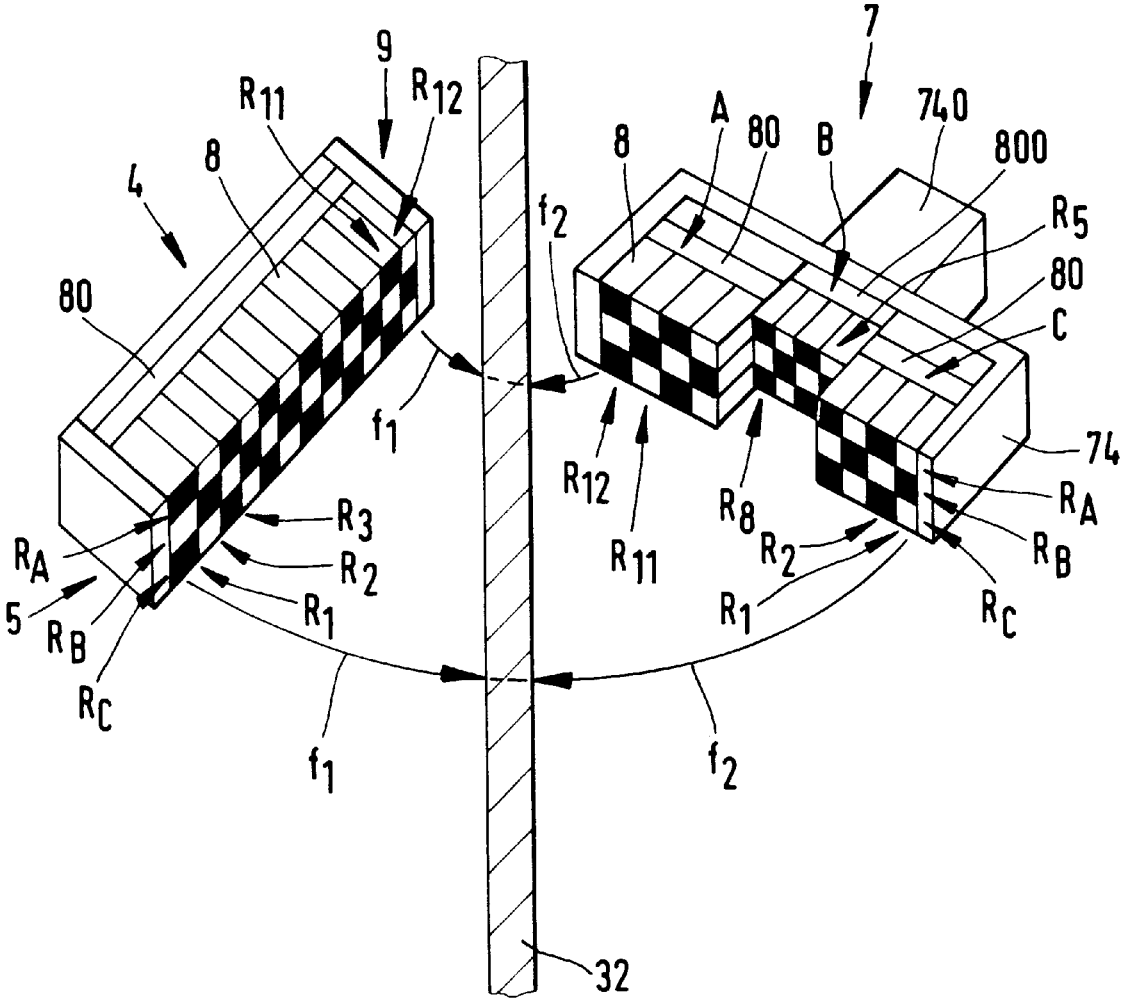

As indicated by arrows $f_1$ and $f_2$, FIG. 4 shows in a type of exploded drawing, a further modification of of the apparatus for control of the can bottom 33.

In this case, the support apparatus 4 as well as the level actuator 4 is comprised of at least one permanent magnet 8. Since, however, by the choice of a greater number of permanent magnets 8, which are combined into a magnet bundle or packet, the magnetic force field and the thereon dependent holding power can be additionally increased. For this reason, the arrangement of FIG. 4 is shown in this way. The support apparatus 4 and the level actuator 7 exhibit respectively an equal number of equally sized permanent magnets 8, which are arranged in several horizontal rows, $R_A$, $R_B$, $R_C$ and also in several columns $R_1$ to $R_{12}$, all located next to one another. In this, the arrangement is so selected that those permanent magnets and sequentially following one another arrayed in a horizontal direction as well as those arrayed in a vertical direction are continually in alternation of north pole (shown in black in FIG. 4) and south pole (in FIG. 4, shown in white) as they face the circumferential shell 32 of the can 3. Beyond this, a north pole of the support apparatus 4 always confronts a south pole of the level actuator 7.

The arrangement of the permanent magnets 8 is to be more closely described again in the following example.

Of the permanent magnets 8, that one which find itself in the second horizontal row $R_B$, and in the third column $R_3$, the south pole (white magnet end) is proximal to the circumferential shell 32. A corresponding permanent magnet 8 opposite this one just described, but on the other side of the circumferential shell 32 of the can 3, is likewise to be found in the second horizontal row $R_B$ and in the third (numbered in mirror image to the columns of the support apparatus 4) column $R_3$ of the level actuator 7, whereby this permanent magnet 8 has its north pole (in the drawing, the black marked magnet end.) proximal to the circumferential shell 32. On the grounds of this arrangement, there arises a checkerboard-like apportionment of the permanent magnets 8 per support apparatus 4, as well as the level actuator 7.

In this arrangement, the permanent magnets 8, as well as the support apparatus 4 and the level actuator 7 respectively, by means of a common steel plate 80 on their side remote from the circumferential shell 32 of the can 3 are magnetically short circuited, which leads to an increase of the efficiency of the magnet array.

A further optimization of the efficiency of the magnetic arrangement is achieved through the choice of Neodym as the choice for the material of the permanent magnets 8.

Also, with the aid of the embodiment shown in FIG. 4, magnetic elements (permanent magnets 8) build by means of the magnetic force field a non-physical contact control connection between the level actuator 7 and the support apparatus 4.

In addition, other materials or arrangements for the permanent magnets can be seen as advantageous, whereby even the most different arrangements of short circuit plates, pole-shoes etc. can come into use, if such as these show themselves to be practical.

In the course of the design of level actuator 7 in the form of permanent magnet packets, in order to be able to bring about the matching of the holding force of the support apparatus 4 to the continually increasing weight of the deposited layers 21 of fiber band 2 on the can bottom 33—irrespective as to whether the support apparatus is again made of a group of permanent magnets 8, or is principally in the form of a ferromagnetic element—the level actuator 7 will possess at least two groups of permanent magnets 8. In accord with FIG. 4, the provision was made that not only two, but even three of the groups A, B and C are arranged side by side. Of these groups, the two outer groups A and C are placed stationary in a holder 74, while the middle group B, with the permanent magnets 8 and the magnetic short circuit plate 800 having the horizontal rows $R_A$, $R_B$ and $R_C$ as well as the columns or vertical rows $R_5$ to $R_8$, is, by means of a drive 740 in the holder 74, retractable in such a manner that it is responsive to the desired holding force, and can come into alignment with the external groups A and C, or relative to these, can be so far retracted that it (i.e. the said middle group B) can have no (essential) effect on the permanent magnets 8 or the ferro magnetic element on the support apparatus 4 on the other side of the circumferential shell 32 of the can 3.

In accordance with the desired gradation of the braking force or the holding force, correspondingly more groups than shown on FIG. 4 can be provided and brought, one after the other, into operational position and thus made to confront the support apparatus 4.

Under these circumstances, it becomes self evident, that the support apparatus 4 is to be designed in such a manner that each permanent magnet 8 of the level actuator 7, which can possibly be brought into operation, must have an opposite, matching permanent magnet 8 (or ferro magnetic element) of the support apparatus 4 of sufficient strength to confront it.

Also, in this matter, it is possible that by means of appropriate choice of the strength of the magnetic field, (gradual activation of the permanent magnets 8), the increasing weight of the fiber band 2 deposited on the can bottom 33 can press the said can bottom 33 downward. When this is done, between the permanent magnets 8 of the support apparatus 4 on the one hand, and those of the level actuator 7 on the other hand, there is registered by an element 73 (see FIG. 3) that now, with the help of the level control device 6, the strength of the magnetic force field increases by activation (presentation) of further permanent magnets 8 of the level actuator 7, as well as a compensating position correction is carried out by the level actuator 7.

Since, in the case of permanent magnets 8, the magnetic force is constantly active, these magnets form a continuously effective holding assurance, so that, with such a design, neither a safety catch 5 of the above described type, nor a common carrier 40 for several support apparatuses 4 is necessary.

In conformance with the embodiments described with the aid of FIGS. 1 and 2, the auxiliary brace 9 for the support apparatus 4 is made in the form of rollers 43 and 44 (or corresponding roller pairs). In similar fashion, such rollers as 43 and 44 can be assigned to the level actuator 7, independently of their special design and method of operation. Thus, it is entirely possible to make available for the filling operation, the magnetic elements as well as the support apparatus 4 along with the level actuator 7 of the can 3, rather than create an idle period in which these release the can 3 so that a filled can 3 may be exchanged for an empty can to be filled.

The auxiliary brace 9 of the support apparatus 4 and/or the level actuators 7 can be designed in the most varied ways.

Thus, for instance in accord with FIG. 3, the auxiliary brace 9 is provided in the form of skids 48 for the support apparatus 4. In case it is desirable, alternatively, the holding means, for instance the pivot arm 720 of the level actuator 7 and/or the holding for the support apparatus or apparatuses 4, form the momentary auxiliary brace 9 and so assure the desired spatial interval "b" to the circumferential shell 32 of the can 3. This spatial interval "b" is so determined by force transmission by means of magnetic or electric force fields between the level actuator 7 and the support apparatus 4 that, on the one hand the desired braking or holding force is assured, on the other hand, however, a movement of these apparatuses along a generatrix of the can 3 is made possible in order that the can bottom 33 can be brought into the desired position. This can be accomplished, for instance, by means of control of the active magnetic force (control of the electromagnets 72 or the release—retraction of—and reactivation of groups A to C etc. of the permanent magnets 8), wherein, if necessary, the support apparatus 4 along with the level actuator 7 can be placed directly on the respective inner or outer sides of the circumferential shell of the can 3.

As already indicated, in the case of a can 3 with a circular cross-section, the can 3 is set into a rotary motion during the filling procedure. While this is in progress, the support apparatuses 4 and the possibly provided level actuators 7 remain in an unchanged position as far as the said rotation is concerned, and never-the-less simply carry out their mentioned thrust movements. The inside of the circumferential shell 32 is, on this account, designed to be as smooth as possible, that is, without reinforcing ribs 34 or the like, so that the can 3 can perform the required rotation motion relative to the support apparatus 4.

Even though it has been presupposed in the embodiment described with the help of the FIGS. 1 and 2, that the support apparatuses 4 are sometimes arranged pair-wise across from one another, a modified version is entirely possible.

With round cans 3, for instance, three or more support apparatuses 4, disposed at equal intervals around the circumference of the can 3 can be provided.

In the case of the so-called rectangular cans, also two support apparatuses 4 can be placed across from one another on the short can sides or, alternatively, or yet, in addition, support apparatuses 4 can be placed at apportioned distances from one another either singly or pair-wise on the inner periphery of the said rectangular can.

It should be apparent to those skilled in the art that various modifications and variations can be made in the present invention without departing from the scope and spirit of the invention. It is intended that the invention include such modifications and variations as come within the scope of the appended claims and their equivalents.

What is claimed is:

1. A process for filling cans with fiber band in a textile machine wherein the cans have a vertically movable can bottom upon which the fiber band is deposited, the can bottom supported within a circumferential shell so as to move downwardly from an initial upper position to a final lower position as filling of the can proceeds, said process comprising generating a force field between elements located inside the circumferential shell and outside the circumferential shell in such a manner that the element inside the circumferential shell supports and holds the can bottom at generally the same elevation as the element outside of the circumferential shell.

2. The process as in claim 1, further comprising controlling lowering of the can bottom from the initial upper position by moving one of the inside or outside elements such that the force field generated between the elements causes the other respective element to follow until the elements are aligned at the same height.

3. The process as in claim 1, further comprising generating a controlling frictional force between the can bottom and an inside surface of the circumferential shell in opposite to downward movement of the can bottom which would result from the weight of the can bottom and fiber band.

4. The process as in claim 3, further comprising adjusting the frictional force as fiber silver is added on top of the can bottom so that the can bottom moves in a controlled manner to the final lower position.

5. An apparatus for filling cans with fiber band in a textile machine wherein said cans include a vertically movable can bottom enclosed by a circumferential shell, said apparatus comprising:

a support apparatus disposed within said shell upon which said can bottom is supported in its movement between an initial upper position and a final lower position upon fiber band being deposited into said can;

a force field generating system configured for controlling movement of said can bottom, said force field generating system comprising a first element disposed within said shell and configured with said support apparatus, and a second element disposed outside of side shell, said elements generating a force field therebetween through said shell;

an actuator vertically movable along an outside of said shell, said second element configured with said actuator so as to move therewith vertically along said can;

a level control device connected in communication with said actuator; and wherein because of said force field, relative vertical movement between said elements causes said first element to move vertically to align with said second element until said elements are aligned at generally the same height.

6. The apparatus as in claim 5, wherein said elements are magnetic elements and said force field is a magnetic field.

7. The apparatus as in claim 6, wherein said first element configured with said can bottom is a ferro-magnetic element formed integral with said can bottom.

8. The apparatus as in claim 6, wherein said second element configured with said actuator is a permanent magnet.

9. The apparatus as in claim 5, wherein said elements each comprise a plurality of permanent magnets arranged in adjacent rows with alternating north and south poles proximate to said circumferential shell such that a said magnet of said first element has a plurality opposite from that of a facing magnet of said second element.

10. The apparatus as in claim 9, wherein said second element comprises groups of said permanent magnets, at least one of said groups movable towards and away from said circumferential shell to vary the strength of said force field.

11. The apparatus as in claim 9, wherein each of said elements includes a short circuit plate adjacent ends of said permanent magnets.

12. The apparatus as in claim 6, wherein said second element configured with said actuator is an electro magnet.

13. An apparatus for filling cans with fiber band in a textile machine wherein said cans include a vertically movable can bottom enclosed by a circumferential shells, said apparatus comprising:

at least one support apparatus disposed within said shell upon which said can bottom is supported in its movement between an initial upper position and a final lower position;

said support apparatus engaged against an inner surface of said shell for moving and breaking said can bottom relative to said shell; and a level control device in operable communication with said support apparatus for controlling movement thereof.

14. The apparatus as in claim 13, comprising at least two said support apparatuses.

15. The apparatus as in claim 14, wherein said at least two support apparatuses are borne by a common carrier and include a lift drive to move said can bottom to said initial upper position, said support apparatuses connected to an external energy.

16. The apparatus as in claim 13, wherein said support apparatus is frictionally breakable relative to said shell such that said can bottom can be maintained at a given vertical position independent of the degree of fullness of said can.

17. The apparatus as in claim 16, wherein said support apparatus comprises a variable strength brake mechanism frictionally engaged against said shell.

18. The apparatus as in claim 13, further comprising a level actuator disposed for vertical movement along an outside of said shell, said level actuator in communication with said level control device, said level actuator generating a release signal to free said can upon said can bottom reaching a given lower position.

19. The apparatus as in claim 18, further comprising a signal sender/receiver operably configured between said level actuator and said support apparatus, wherein upon a height deviation existing between said level actuator and said support apparatus, a signal is generated to cause a compensating movement of either of said support apparatus and said level actuator.

20. The apparatus as in claim 13, further comprising a safety catch mechanism configured to engage and hold said support apparatus relative to said shell upon a loss of power to said support mechanism.

21. The apparatus as in claim 18, wherein said support apparatus and said level actuator are moveable towards and away from said shell to accommodate bulges in said shell.

* * * * *